US006360703B1

(12) United States Patent
Rahbar et al.

(10) Patent No.: US 6,360,703 B1
(45) Date of Patent: Mar. 26, 2002

(54) INSERT MOLDED ELECTRONICALLY CONTROLLED ENGINE COOLING MODULE FOR DC MOTORS

(75) Inventors: Mehran K. Rahbar; Marek Horski, both of London (CA)

(73) Assignee: Siemens Automotive, Inc., Mississauga (CA)

( * ) Notice: Subject to any disclaimer, the term of this patent is extended or adjusted under 35 U.S.C. 154(b) by 0 days.

(21) Appl. No.: 09/552,339

(22) Filed: Apr. 18, 2000

Related U.S. Application Data

(60) Provisional application No. 60/171,377, filed on Dec. 22, 1999.

(51) Int. Cl.[7] ..... F01P 7/10

(52) U.S. Cl. ..... 123/41.49

(58) Field of Search ..... 123/41.49, 41.11, 123/41.12; 416/170 R

(56) References Cited

U.S. PATENT DOCUMENTS

| | | | | |
|---|---|---|---|---|
| 3,579,007 A | | 5/1971 | Walter | 310/242 |
| 4,128,364 A | | 12/1978 | Papst et al. | 417/354 |
| 4,210,833 A | | 7/1980 | Neveux | 310/58 |
| 4,228,376 A | | 10/1980 | Mabuchi | 310/242 |
| 4,311,936 A | | 1/1982 | Ozaki et al. | 310/242 |
| 4,459,087 A | | 7/1984 | Barge | 417/356 |
| 4,563,622 A | | 1/1986 | Deavers et al. | 318/254 |
| 4,682,065 A | | 7/1987 | English et al. | 310/90 |
| 4,823,032 A | | 4/1989 | Ward et al. | 310/43 |
| 4,877,986 A | | 10/1989 | Shimizu | 310/153 |
| 4,888,511 A | | 12/1989 | Aoki | 310/237 |
| 4,962,734 A | * | 10/1990 | Jorgensen | 123/41.49 |
| 5,006,742 A | | 4/1991 | Strobl et al. | 310/88 |
| 5,006,744 A | | 4/1991 | Archer et al. | 310/89 |
| 5,019,735 A | | 5/1991 | Lee | 310/89 |
| 5,047,679 A | | 9/1991 | Baader et al. | 310/89 |
| 5,135,363 A | | 8/1992 | Harmsen et al. | 417/354 |
| 5,194,770 A | | 3/1993 | Yoshioka et al. | 310/51 |
| 5,244,347 A | | 9/1993 | Gallivan et al. | 416/189 |
| 5,267,842 A | | 12/1993 | Harmsen et al. | 417/354 |
| 5,326,225 A | | 7/1994 | Gallivan et al. | 416/179 |
| 5,327,036 A | | 7/1994 | Carey | 310/89 |
| 5,460,485 A | | 10/1995 | Sugiyama et al. | 415/208.2 |
| 5,608,280 A | | 3/1997 | Tamemoto et al. | 310/239 |
| 5,654,598 A | | 8/1997 | Horski | 310/67 R |
| 5,757,096 A | | 5/1998 | DuBois et al. | 310/68 D |
| 5,818,133 A | | 10/1998 | Kershaw et al. | 310/67 R |
| 5,932,942 A | | 8/1999 | Patyk et al. | 310/58 |
| 5,939,807 A | | 8/1999 | Patyk et al. | 310/89 |

* cited by examiner

*Primary Examiner*—Tony M. Argenbright
*Assistant Examiner*—Katrina B. Harris

(57) ABSTRACT

An engine cooling module includes a shroud structure, and a brushless dc electric motor having an armature assembly and a rotor carrying permanent magnets. Mounting structure is provided having first and second opposing surfaces. The armature assembly is fixedly coupled with respect to the first surface. The mounting structure is fixed to the shroud structure. A fan has a plurality of blades and a hub. The rotor is fixed with respect to the hub. A shaft is associated with the rotor and the armature assembly permitting rotation of the rotor with resect to the armature assembly. An electronic control unit is coupled to the second surface of the mounting structure and is electrically connected with the armature assembly to control operation of the motor.

20 Claims, 4 Drawing Sheets

INSERT MOLDED ELECTRONICALLY CONTROLLED ENGINE COOLING MODULE FOR DC MOTORS

This application claims the benefit of U.S. Provisional Application No. 60/171,377, filed Dec. 22, 1999, which is hereby incorporated by reference in its entirety herein.

FIELD OF THE INVENTION

This invention relates engine cooling modules for automotive applications and more particularly to a cooling module having fewer parts and therefor easier to manufacture and assemble.

BACKGROUND OF THE INVENTION

Typical cooling modules for vehicle engines generally include three separate parts: a fan, an electric motor to drive the fan, and a shroud to direct air flow and to mount the module. As a result of using separate parts, many subassemblies need to be performed to complete the final assembly of the module. Further, since the motor is separate from the shroud, the motor requires a case and end caps at both ends thereof which increases the weight of the module.

In certain applications, due to space and environmental constraints, it is desirable to provide an engine cooling module of reduced axial length and, to reduce costs and overall module weight, having reduced number of module parts.

Accordingly, there is a need to provide an improved cooling module for an electronically controlled engine which has a motor integrated with a fan and a shroud to provide a module having a reduced axial length and fewer parts.

SUMMARY OF THE INVENTION

An object of the present invention is to fulfill the need referred to above. In accordance with the principles of the present invention, this objective is obtained by providing an engine cooling module including a shroud structure, and a brushless dc electric motor having an armature assembly and a rotor carrying permanent magnets. Mounting structure is provided having first and second opposing surfaces. The armature assembly is fixedly coupled with respect to the first surface. The mounting structure is fixed to the shroud structure. A fan has a plurality of blades and a hub. The rotor is fixed with respect to the hub. A shaft is associated with the rotor and the armature assembly permitting rotation of the rotor with resect to the armature assembly. An electronic control unit is coupled to the second surface of the mounting structure and is electrically connected with the armature assembly to control operation of the motor.

In accordance with another aspect of the invention, a method of assembling an engine cooling module provides a shroud structure having a support. A mounting structure is insert molding to the support. A fan is provided having a plurality of blades extending from a hub. A rotor assembly is insert molded to be fixed to the hub. The rotor assembly includes a rotor carrying permanent magnets, and a shaft. An armature assembly is mounted with resect to a first surface of the mounting structure. The armature assembly has a bearing set. The shaft is supported by the bearings so that the rotor may rotate with respect to the armature assembly. An electronic control unit is mechanically coupled to a surface of the mounting structure opposite the first surface thereof and the electronic control unit is electrically connected to armature assembly.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

Figure 1:
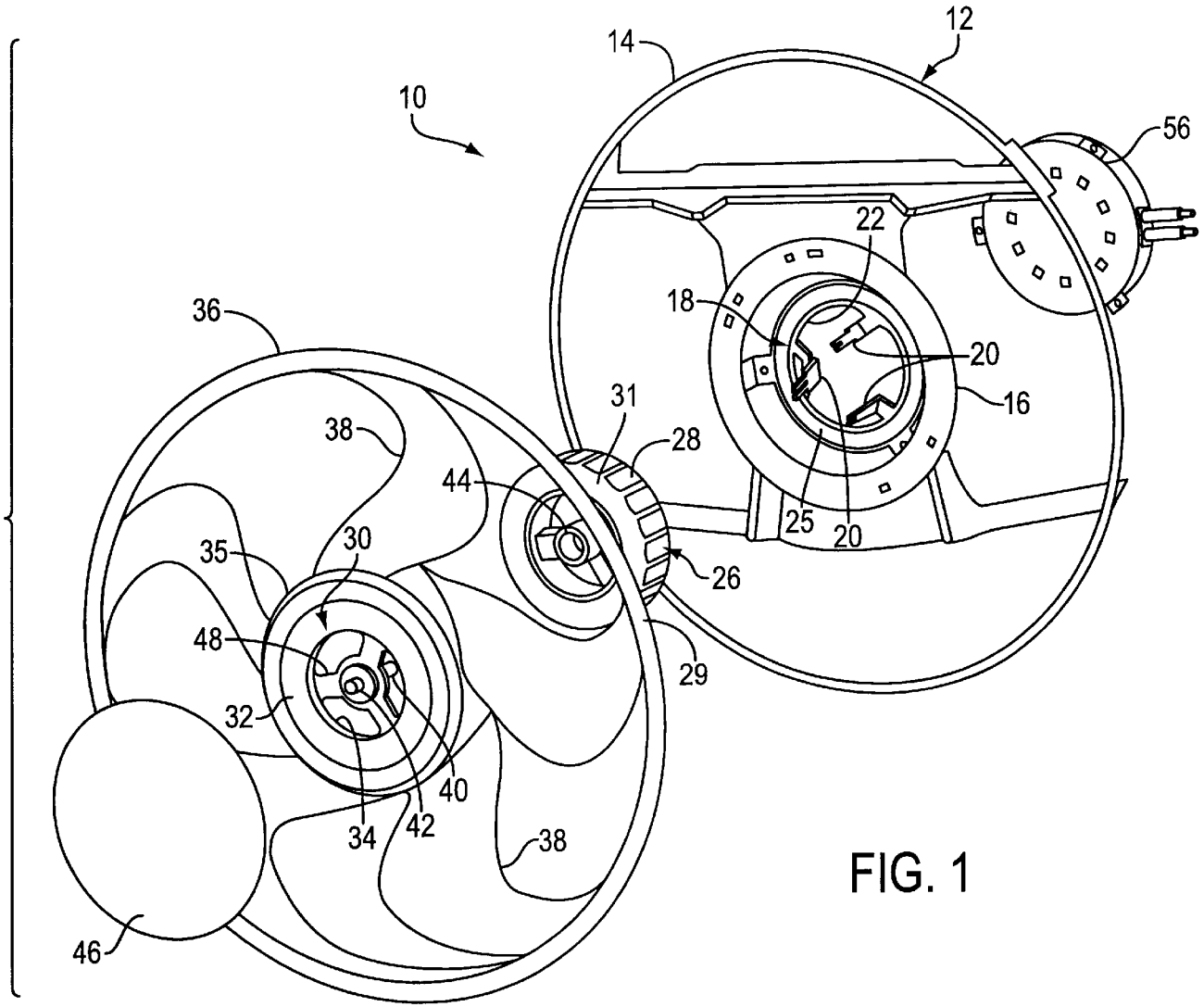
FIG. 1 is an exploded view of a engine cooling module as seen from the front thereof, provided in accordance with the principles of the present invention.

Referring to FIG. 1, an engine cooling module is shown in exploded view, generally indicated 10, provided in accordance with the principles of the present invention. The cooling module 10 includes a shroud structure, general indicated at 12, formed preferably of lightweight material such as plastic. The shroud structure 12 has an annular outer band 14 and a support 16 coupled to the outer band.

Figure 2:
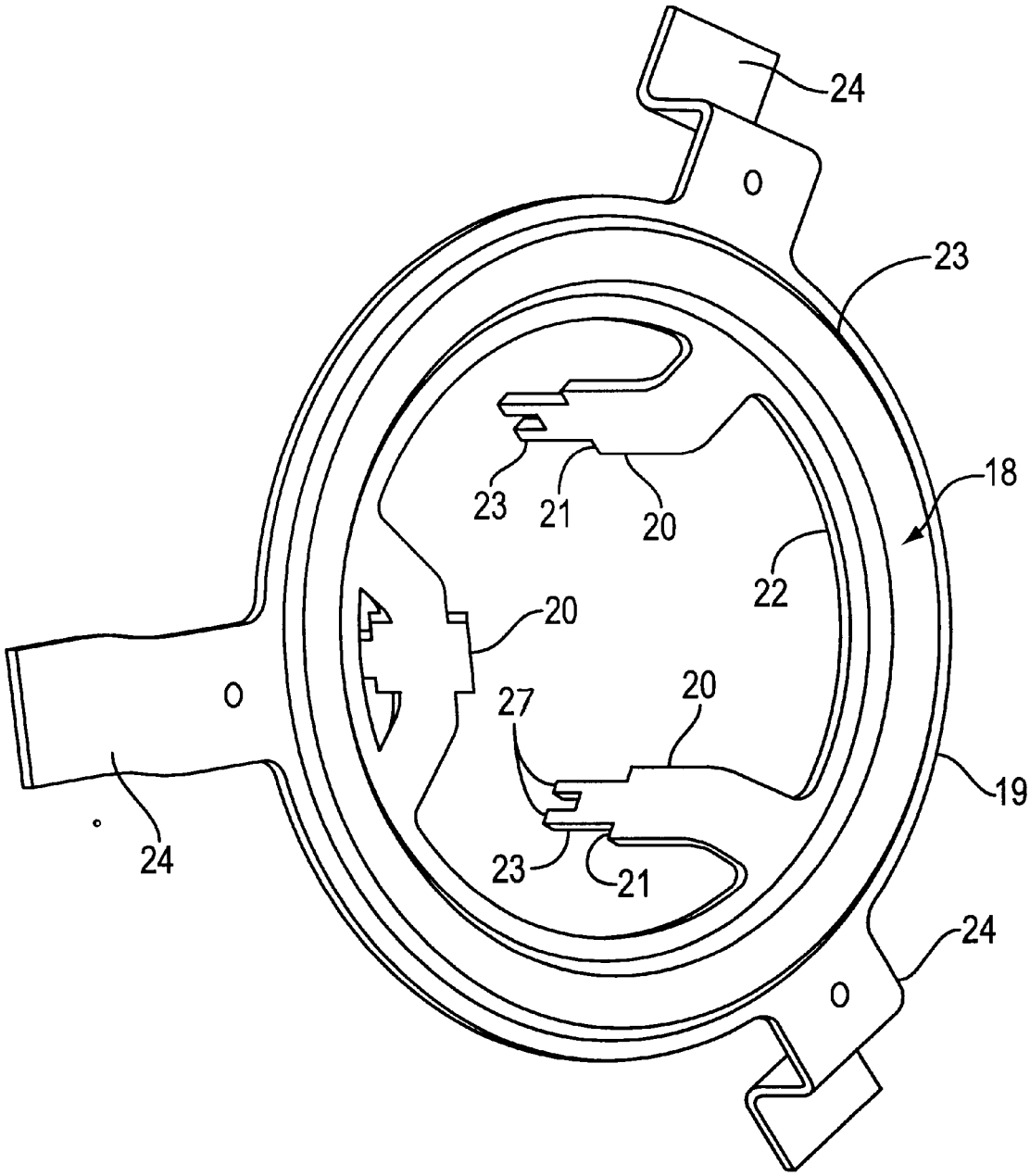
FIG. 2 is a perspective view of a stator mounting bracket of the cooling module of FIG. 1.

The module 10 includes mounting structure, generally indicated at 18 in FIG. 1. As shown in FIGS. 1 and 2, the mounting structure 18 is in the form of a ring 19 having opposing surfaces 23 and 25. A plurality of projecting tabs 20 extend from an inner periphery 22 of the ring 19. In the illustrated embodiment, three tabs 20 are provided and are spaced equally about the inner periphery 22. Each tab 20 includes a shoulder 21 and a forked-shaped member 23 extending from the shoulder 21. The mounting structure 18 also includes mounting legs 24 extending outwardly from the ring 19. The mounting legs 24 are insert molded to the support 16 of the shroud structure 12 so as to be fixed thereto. In other words, during a molding process, material such as plastic is molded to secure the mounting legs 24 to the support 16. The function of the mounting 18 structure will be explained below.

Returning to FIG. 1, the module 10 includes an armature assembly, generally indicated at 26. The armature assembly 26 comprises an annular steel core member 28 supported by ribs 29 which define a central support structure. The core member 28 may be a solid member or may be comprised of a plurality of laminations in the conventional manner. The armature assembly 26 also includes a conventional winding set 31 wound about the core member 28. The armature assembly 26 is coupled to the mounting structure 18 so that surfaces of the ribs 29 rest on the shoulders 21 of the tabs with the forked-shaped members 23 extending through apertures in the ribs 29 in a clinching arrangement. The clinching arrangement is defined by moving the legs 27 of each forked shaped member 23 in opposite directions. Thus, the armature assembly 26 is fixed with respect to surface 25 of the mounting structure 18 without fasteners.

Figure 3:
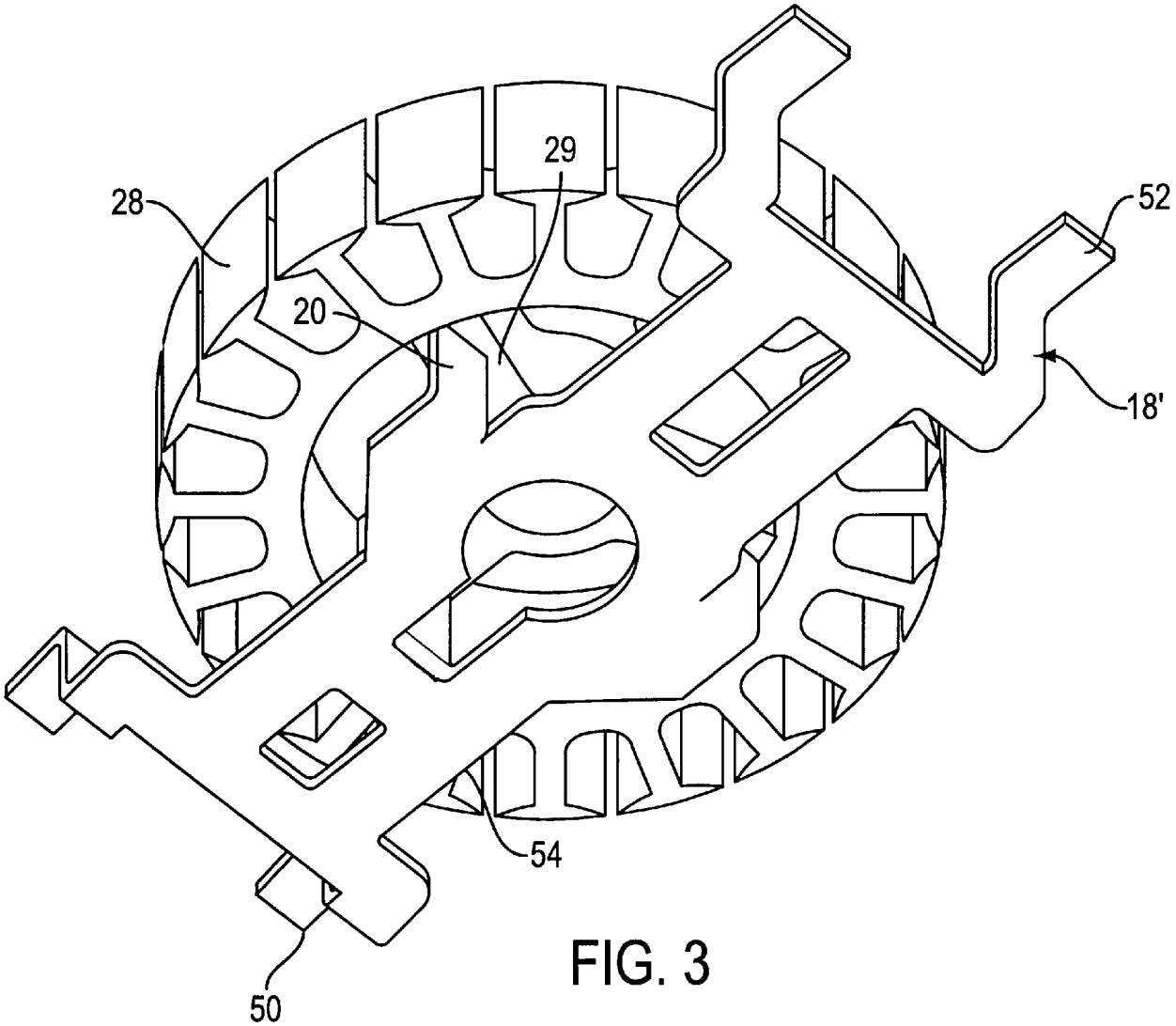
FIG. 3 is a rear perspective view of a second embodiment of a motor mounting bracket of the invention, shown with a core member coupled thereto.
Figure 4:
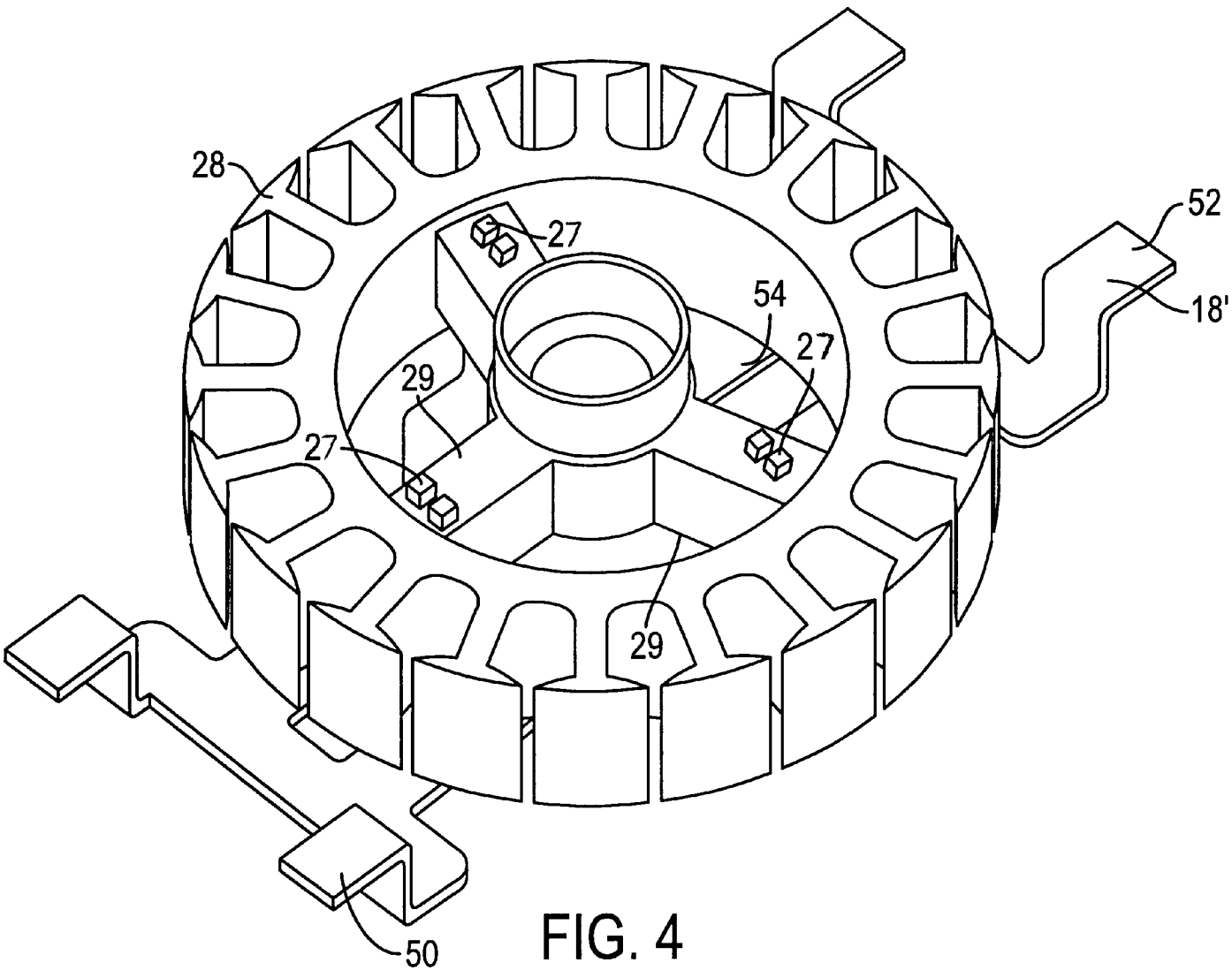
FIG. 4 is a front perspective view of a motor mounting bracket of FIG. 3, shown with a core member coupled thereto.

A second embodiment of the mounting structure is shown in FIGS. 3 and 4. The mounting structure 18' includes two ends 50 and 52 joined by a bracket member 54. Ends 50 and 52 are insert molded with respect to the support 16 in a manner similar to the legs 24 of the embodiment of FIGS. 1 and 2. The bracket member 54 includes three projecting tabs 20 which are secured to the central support structure (ribs 29) of the core member 28 as discussed above with regard to the embodiment of FIGS. 1 and 2.

The module 18 further includes a rotor assembly, generally indicated at 30. The rotor assembly 30 includes a rotor 32 and permanent magnets 34 fixed to the rotor 32 so as to cooperate with the armature assembly 26 when the module 18 is assembled. Thus, the rotor assembly 30 and the armature assembly define a brushless d.c. motor. In the illustrated embodiment, the rotor 32 and the magnets 34 are insert molded with respect to a hub 35 of a fan 36. Thus, during a molding process the rotor 32 and magnets 34 are molded via plastic material to be integral with the hub 35. The insert molded rotor 32 and magnets 34 eliminate the magnet-rotor subassembly and rotor-shroud final assembly of the conventional cooling module. The fan 36 has a plurality of blades 38 extending from the hub 35.

The rotor assembly 30 also includes a shaft 40 coupled to the rotor 32 near end 42 and supported for rotation by bearing 44 of the armature assembly 26 at the other end of the shaft 40.

An air directing member 46 is coupled to ribs 48 of the rotor 30 to define an air directing space as described in U.S. Pat. No. 5,944,497, the contents of which is hereby incorporated into the present specification by reference.

With reference to FIG. 1, an electronic control unit 56 is coupled to surface 23 (FIG. 2) of the mounting structure 18. The electronic control unit is electrically connected the winding set 31 to control operation of the motor in the conventional manner.

In the conventional manner, the cooling module 10 of the invention can be mounted as a unit to be operatively associated with a radiator of a vehicle for cooling the engine of the vehicle. The cooling module, of the invention is of reduced axial length as compared to conventional cooling modules. Advantageously, the reduced axial length cooling module of the invention does not consume as much valuable engine compartment space as does conventional cooling modules.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An engine cooling module comprising:

a shroud structure, a brushless dc electric motor having an armature assembly and a rotor carrying permanent magnets, mounting structure having first and second opposing surfaces, said armature assembly being fixedly coupled with respect to said first surface, said mounting structure being fixed to said shroud structure, a fan having a plurality of blades and a hub, said rotor being fixed with respect to said hub, a shaft associated with said rotor and armature assembly permitting rotation of said rotor with resect to said armature assembly, and an electronic control unit coupled to said second surface of said mounting structure and being electrically connected with said armature assembly to control operation of said motor.

2. The engine cooling module according to claim 1, wherein said armature assembly includes a core member and a winding set wound about said core member, said electronic control unit being electrically coupled to said winding set.

3. The engine cooling module according to claim 2, wherein said core member is annular and has a central support structure.

4. The engine cooling module according to claim 3, wherein said mounting structure includes projecting tabs engaged with said central support structure to secure said armature assembly to said mounting structure.

5. The engine cooling module according to claim 4, wherein each said tab includes a forked-shaped member extending through said central support structure in a clinching arrangement.

6. The engine cooling module according to claim 1, wherein said rotor and said magnets are fixed to said hub via molded material.

7. The engine cooling module according to claim 1, wherein said mounting structure is fixed to said shroud structure via moulded material.

8. The engine cooling module according to claim 4, wherein said mounting structure is in the form of a ring and said projecting tabs extend from an inner periphery of said ring.

9. The engine cooling module according to claim 8, wherein three projecting tabs are provided and are equally spaced about said inner periphery.

10. The engine cooling module according claim 4, wherein said mounting structure has two ends joined by a bracket member, said ends being coupled to said shroud structure and said bracket member including said projecting tabs.

11. An engine cooling module comprising:

a shroud structure, a brushless dc electric motor having an armature assembly and a rotor carrying permanent magnets, mounting structure having first and second opposing surfaces, said armature assembly being fixed with respect to said first surface, said mounting structure being insert molded with respect to said shroud structure, a fan having a plurality of blades extending from a hub, said rotor being insert molded with respect to said hub, a shaft associated with said rotor and armature assembly permitting rotation of said rotor with resect to said armature assembly, and an electronic control unit coupled to said second surface of said mounting structure and being electrically connected with said armature assembly to control operation of said motor.

12. The engine cooling module according to claim 11, wherein said armature assembly includes a core member and a winding set wound about said core member, said electronic control unit being electrically coupled to said winding set.

13. The engine cooling module according to claim 12, wherein said core member is annular and has a central support structure.

14. The engine cooling module according to claim 13, wherein said mounting structure includes projecting tabs engaged with said central support structure to secure said armature assembly to said mounting structure.

15. The engine cooling module according to claim 14, wherein each said tab includes a forked-shaped member extending through said central support structure in a clinching arrangement.

16. The engine cooling module according to claim 14, wherein said mounting structure is in the form of a ring and said projecting tabs extend from an inner periphery of said ring.

17. The engine cooling module according to claim 16, wherein three projecting tabs are provided and are equally spaced about said inner periphery.

18. The engine cooling module according to claim 14, wherein said mounting structure has two ends joined by a bracket member, said ends being coupled to said shroud structure and said bracket member including said projecting tabs.

19. A method of providing an engine cooling module comprising:

providing a shroud structure having a support, insert molding a mounting structure to said support, providing a fan having a plurality of blades extending from a hub, insert molding a rotor assembly so as to be fixed to said hub, said rotor assembly including a rotor carrying permanent magnets, and a shaft, mounting an armature assembly with resect to a first surface of said mounting structure, said armature assembly having bearings, supporting said shaft with respect to said bearings so that said rotor may rotate with respect to said armature assembly, and mechanically coupling an electronic control unit to a surface of said mounting structure opposite said first surface thereof and electrically connecting said electronic control unit to said armature assembly.

20. The method according to claim 19, wherein said mounting structure includes projecting tabs and said armature assembly includes a core member carrying a winding set, said core member having a central support structure, the method including engaging said projecting tabs with said central support structure to mount said armature assembly to said mounting structure.

* * * * *